US009352579B2

(12) United States Patent
Kobayashi

(10) Patent No.: US 9,352,579 B2
(45) Date of Patent: May 31, 2016

(54) LIQUID EJECTING HEAD AND LIQUID EJECTING APPARATUS

(75) Inventor: Haruki Kobayashi, Shiojiri (JP)

(73) Assignee: Seiko Epson Corporation (JP)

( * ) Notice: Subject to any disclaimer, the term of this patent is extended or adjusted under 35 U.S.C. 154(b) by 239 days.

(21) Appl. No.: 13/564,976

(22) Filed: Aug. 2, 2012

(65) Prior Publication Data

US 2013/0033550 A1 Feb. 7, 2013

(30) Foreign Application Priority Data

Aug. 3, 2011 (JP) ..... 2011-169837

(51) Int. Cl.
*B41J 2/175* (2006.01)

(52) U.S. Cl.
CPC ..... *B41J 2/17553* (2013.01); *B41J 2/17513* (2013.01)

(58) Field of Classification Search
CPC ..... B41J 2202/20
USPC ..... 347/47, 85, 43, 71
See application file for complete search history.

(56) References Cited

U.S. PATENT DOCUMENTS

| | | | | |
|---|---|---|---|---|
| 4,559,544 | A * | 12/1985 | Matsumoto et al. | 347/71 |
| 5,790,155 | A * | 8/1998 | Usui et al. | 347/68 |
| 6,042,223 | A * | 3/2000 | Katakura | 347/68 |
| 6,953,241 | B2 * | 10/2005 | Sakaida et al. | 347/68 |
| 7,052,118 | B2 * | 5/2006 | Akahane | 347/68 |
| 7,367,651 | B2 * | 5/2008 | Kang | 347/43 |
| 7,571,997 | B2 * | 8/2009 | Nakamura | 347/92 |
| 7,900,355 | B2 * | 3/2011 | Hirota | 29/890.1 |
| 8,210,660 | B2 * | 7/2012 | Anderson et al. | 347/71 |
| 2003/0156167 | A1 * | 8/2003 | Sakaida et al. | 347/68 |
| 2004/0066430 | A1 * | 4/2004 | Sekiguchi | 347/40 |
| 2004/0085394 | A1 | 5/2004 | Martin | |
| 2005/0231554 | A1 * | 10/2005 | Sakaida et al. | 347/48 |
| 2005/0259127 | A1 * | 11/2005 | Enomoto et al. | 347/40 |
| 2007/0103507 | A1 * | 5/2007 | Sugahara | 347/40 |
| 2008/0036816 | A1 * | 2/2008 | Nishida | 347/30 |
| 2009/0058899 | A1 * | 3/2009 | Umeda | 347/9 |
| 2009/0189961 | A1 * | 7/2009 | Ito | 347/85 |
| 2010/0073433 | A1 * | 3/2010 | Shimizu et al. | 347/65 |
| 2010/0149254 | A1 | 6/2010 | Yajima et al. | |
| 2011/0122194 | A1 * | 5/2011 | Anderson et al. | 347/44 |
| 2012/0212544 | A1 * | 8/2012 | Price | 347/40 |

FOREIGN PATENT DOCUMENTS

| | | | | |
|---|---|---|---|---|
| JP | 2003-094684 A | | 4/2003 | |
| JP | 2003094684 A | * | 4/2003 | B41J 2/175 |
| JP | 2009-208443 | | 9/2009 | |
| JP | 2010-137428 | | 6/2010 | |

* cited by examiner

*Primary Examiner* — Matthew Luu
*Assistant Examiner* — Patrick King
(74) *Attorney, Agent, or Firm* — Harness, Dickey & Pierce, P.L.C.

(57) ABSTRACT

In a passage unit of a recording head, a first ink introduction port of a first reservoir and a second ink introduction port of a second reservoir are formed between the first and second reservoirs. The first and second ink introduction ports are formed at different positions in a nozzle line direction perpendicular to a main scanning direction and are formed to overlap each other in the main scanning direction.

16 Claims, 10 Drawing Sheets

LIQUID EJECTING HEAD AND LIQUID EJECTING APPARATUS

BACKGROUND

1. Technical Field

The present invention relates to a liquid ejecting head and a liquid ejecting apparatus capable of ejecting a liquid such as ink from nozzles.

2. Related Art

An ink jet printer that includes a recording head, which is an example of a liquid ejecting head, is known as an example of a liquid ejecting apparatus. In an ink jet printer, ink is introduced into the recording head from a liquid container such as an ink cartridge. The ink introduced into the recording head is temporarily stored in a reservoir via an ink introduction port formed inside the recording head. Then, the ink is supplied from the reservoir to a pressure generation chamber. When a pressure generation element such as a piezoelectric element causes a change in the pressure of the ink in the pressure generation chamber, the ink is ejected from a nozzle that communicates with the pressure generation chamber.

JP-A-2009-208443 and JP-A-2010-137428 disclose recording heads that have a structure in which two reservoirs are paired, a total of six reservoirs are formed, and a nozzle line is formed between each pair of two reservoirs. In the recording head disclosed in JPA-2010-137428, the positions of the ink introduction ports formed in the reservoirs are different in a nozzle line direction between the different pairs of reservoirs. Specifically, the recording head disclosed in JP-A-2010-137428 includes a first reservoir in which the ink introduction port is formed near the middle in the nozzle line direction and a second reservoir in which the ink introduction port is formed on the end side of the first reservoir. Therefore, the positions of the ink introduction ports are different in the nozzle line direction. Further, even when high-duty driving is performed, stable ejection characteristics can be obtained by supplying the first reservoir with a kind of ink, of which a meniscus is considerably drawn when high-duty driving is performed, among plural kinds of ink.

In the recording heads disclosed in JPA-2009-208443 and JP-A-2010-137428, however, since the ink introduction ports of the reservoirs are formed at distant positions between the adjacent reservoirs, it is necessary to ensure a large gap between the reservoirs. For this reason, a problem may arise in that the size of the recording head is increased.

SUMMARY

The invention can be realized in the following forms or application examples.

APPLICATION EXAMPLE 1

According to Application Example 1, there is provided a liquid ejecting head which includes a passage formation member in which first and second liquid storage chambers storing a liquid are formed and ejects the liquid stored in the first liquid storage chamber and the liquid stored in the second liquid storage chamber. In the passage formation member, the first and second liquid storage chambers are formed to be spaced in a first direction, and a first introduction port through which the liquid stored in the first liquid storage chamber is introduced and a second introduction port through which the liquid stored in the second liquid storage chamber is introduced are formed between the first and second liquid storage chambers. The first and second introduction ports are formed at different positions in a second direction perpendicular to the first direction and are formed so that at least parts of the first and second introduction ports overlap each other in the first direction.

With such a configuration, since the first and second introduction ports are formed at the different position in the second direction perpendicular to the first direction in which the first and second liquid storage chambers are formed to be spaced, the first and second introduction ports do not interfere with each other. Further, since the first and second introduction ports are formed to overlap each other at least partially in the first direction, the gap between the first and second introduction ports in the first direction can be narrowed. Accordingly, even in the liquid ejecting head in which the gap between the first and second liquid storage chambers is narrow, the first and second introduction ports can be formed between the first and second liquid storage chambers. Therefore, the liquid ejecting head can be miniaturized.

APPLICATION EXAMPLE 2

In the liquid ejecting head according to Application Example 1, in the passage formation member, a plurality of the second liquid storage chambers may be formed, and the second introduction port of each second liquid storage chamber and the first introduction port of the first liquid storage chamber may be formed at different positions in the second direction and may be formed so that at least parts of the first and second introduction ports overlap each other in the first direction.

With such a configuration, the liquid ejecting head including the plurality of second liquid storage chambers can be miniaturized.

APPLICATION EXAMPLE 3

In the liquid ejecting head according to Application Example 1, the first and second introduction ports may be lined up in the second direction.

With such a configuration, since the first and second introduction ports are arranged in the same direction, the first and second introduction ports can be formed at the narrower gap between the first and second liquid storage chambers. Therefore, the liquid ejecting head can be further miniaturized.

APPLICATION EXAMPLE 4

In the liquid ejecting head according to Application Example 1, at least a part of one of the first and second liquid storage chambers oriented toward the introduction port of the other liquid storage chamber may be recessed on the opposite side to the other liquid storage chamber.

With such a configuration, the first and second introduction ports can be formed between the first and second liquid storage chambers and the gap between the first and second liquid chambers can be further narrowed. Therefore, the liquid ejecting head can be further miniaturized.

APPLICATION EXAMPLE 5

In the liquid ejecting head according to Application Example 1, in the passage formation member, a first pressure generation chamber that is formed on an opposite side to the second liquid storage chamber with respect to the first liquid storage chamber and communicates with the first liquid storage chamber and a first nozzle that ejects the liquid of the first pressure generation chamber may be formed. A second pressure generation chamber that is formed on an opposite side to the first liquid storage chamber with respect to the second liquid storage chamber and communicates with the second liquid storage chamber and a second nozzle that ejects the liquid of the second pressure generation chamber may be formed.

With such a configuration, since the pressure generation chambers and the nozzles are not formed between the first and second liquid storage chambers, it is not necessary to enlarge the gap between the first and second liquid storage chambers in order to dispose the pressure generation chambers and the nozzles. Therefore, the liquid ejecting head can be further miniaturized.

APPLICATION EXAMPLE 6

According to Application Example 6, there is provided a liquid ejecting apparatus including a liquid ejecting head that includes a passage formation member in which first and second liquid storage chambers storing a liquid are formed and ejects the liquid stored in the first liquid storage chamber and the liquid stored in the second liquid storage chamber. In the passage formation member, the first and second liquid storage chambers are formed to be spaced in a first direction, and a first introduction port through which the liquid stored in the first liquid storage chamber is introduced and a second introduction port through which the liquid stored in the second liquid storage chamber is introduced are formed between the first and second liquid storage chambers. The first and second introduction ports are formed at different positions in a second direction perpendicular to the first direction and are formed so that at least parts of the first and second introduction ports overlap each other in the first direction.

With such a configuration, the liquid ejecting head can be further miniaturized since the first and second introduction ports can be formed between the first and second liquid storage chambers. Therefore, the liquid ejecting apparatus can be miniaturized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings. In this embodiment, a printer including an ink jet recording head will be described as an example of a liquid ejecting apparatus including a liquid ejecting head.

Figure 1:
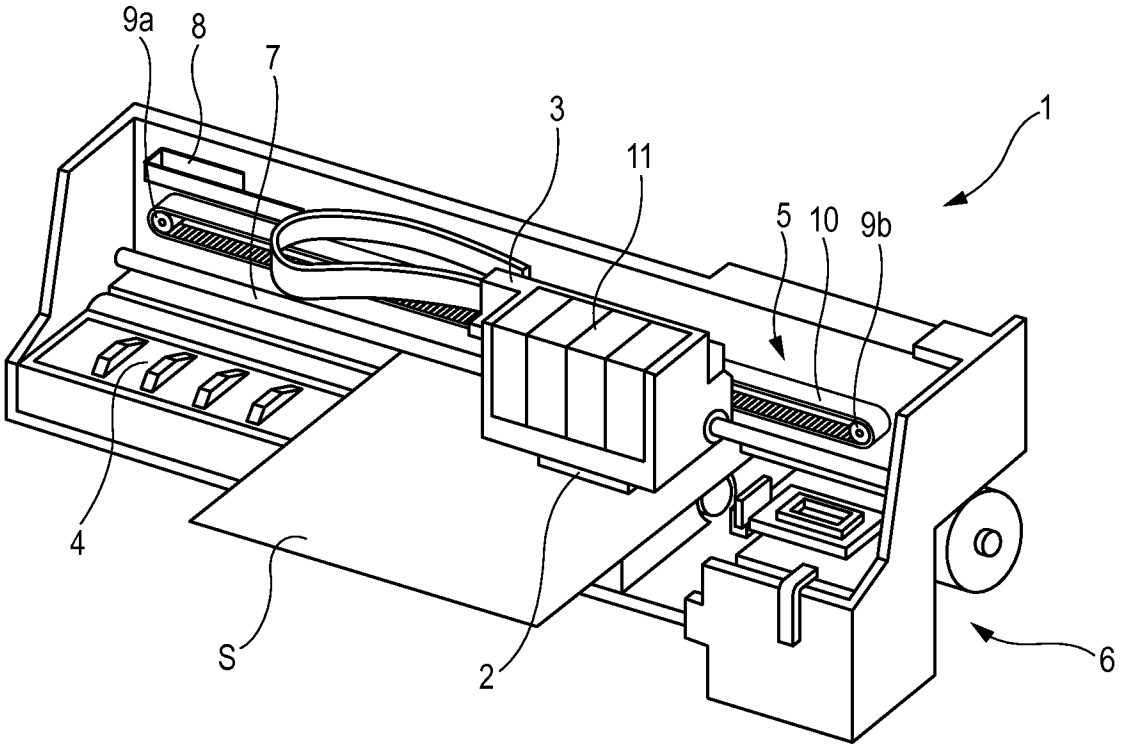
FIG. 1 is a diagram illustrating the overall configuration of a printer according to an embodiment.

FIG. 1 is a diagram illustrating the overall configuration of a printer. As shown in FIG. 1, a printer 1 includes an ink jet recording head unit 2 which is an example of a liquid ejecting head, a carriage 3 on which the recording head unit 2 is mounted, a platen 4 that supports a recording sheet S on which liquid droplets are landed, a carriage movement mechanism 5 that reciprocates the carriage 3 in a sheet width direction of the recording sheet S, and a sheet feeding mechanism 6 that feeds the recording sheet S. The sheet width direction in which the carriage movement mechanism 5 moves the carriage 3 is a main scanning direction and a sheet feeding direction in which the sheet feeding mechanism 6 feeds the recording sheet S is a sub-scanning direction perpendicular to the main scanning direction.

The recording head unit 2 is mounted on the carriage 3. A plurality of ink cartridges 11 are detachably mounted on the carriage 3. In this embodiment, four ink cartridges 11 corresponding to ink colors of cyan ink, magenta ink, yellow ink, and black ink, respectively, are detachably mounted.

The carriage movement mechanism 5 includes a guide rod 7 installed in the main scanning direction, a linear scale 8 of a linear encoder disposed along the main scanning direction, and a timing belt 10 suspended between a carriage motor 9*a* and a driven roller 9*b*. The carriage 3 is shaft-supported to the guide rod 7 so as to be slid, and thus a part of the carriage 3 locks with the timing belt 10. Accordingly, the carriage 3 is moved along the guide rod 7 when the carriage motor 9*a* is driven. Further, the position of the carriage 3 in the main scanning direction is detected when the linear encoder installed in the carriage 3 on the side of the linear scale 8 reads the linear scale 8. A detection signal obtained by the linear encoder is transmitted to a controller (not shown) of the printer 1. The controller recognizes the position of the carriage 3 within a scanning range, that is, recognizes the position of the recording head unit 2 based on the detection signal and controls a recording process performed by the recording head unit 2.

Figure 2:
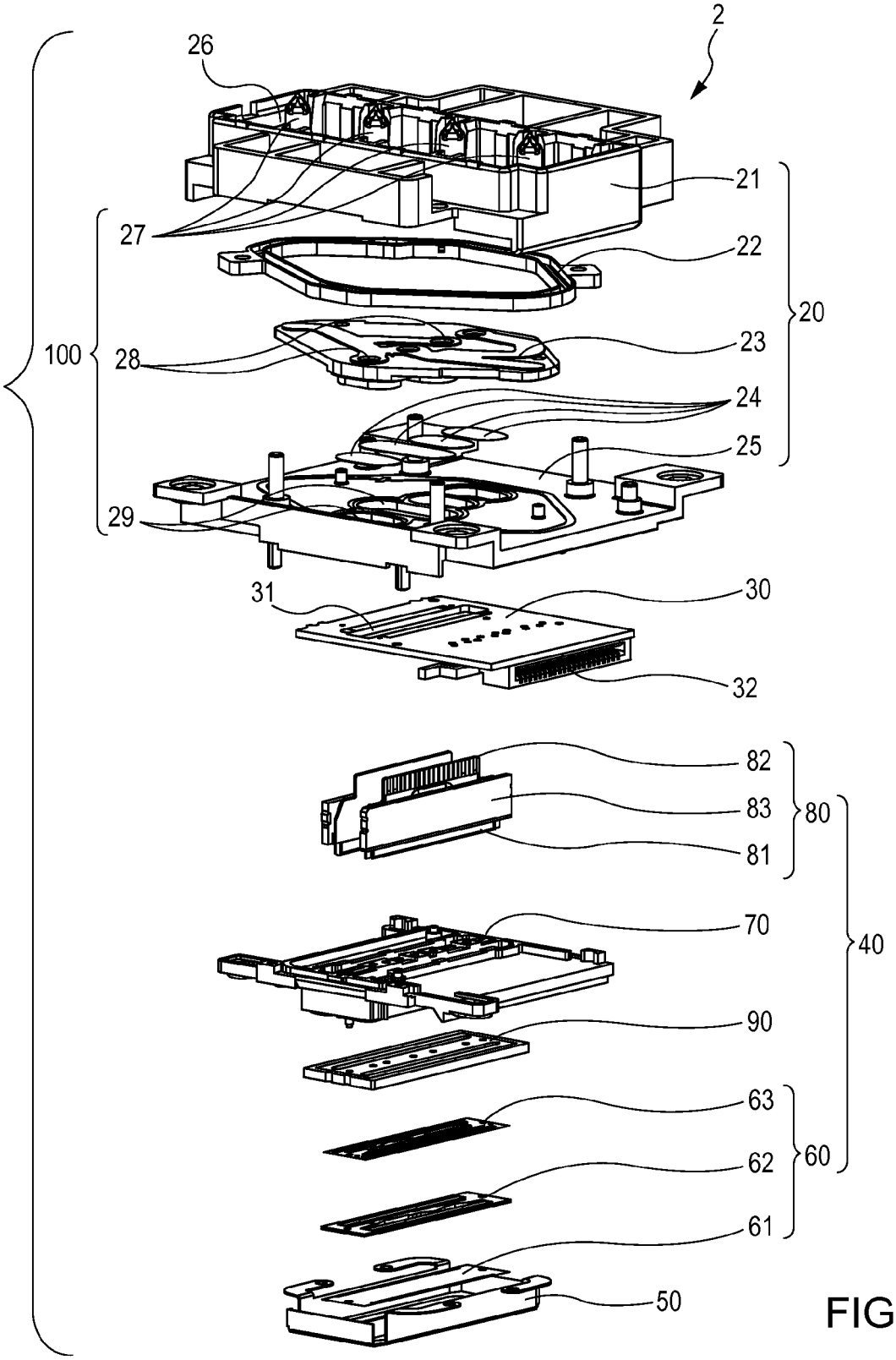
FIG. 2 is an exploded perspective view illustrating a recording head unit.
Figure 3:
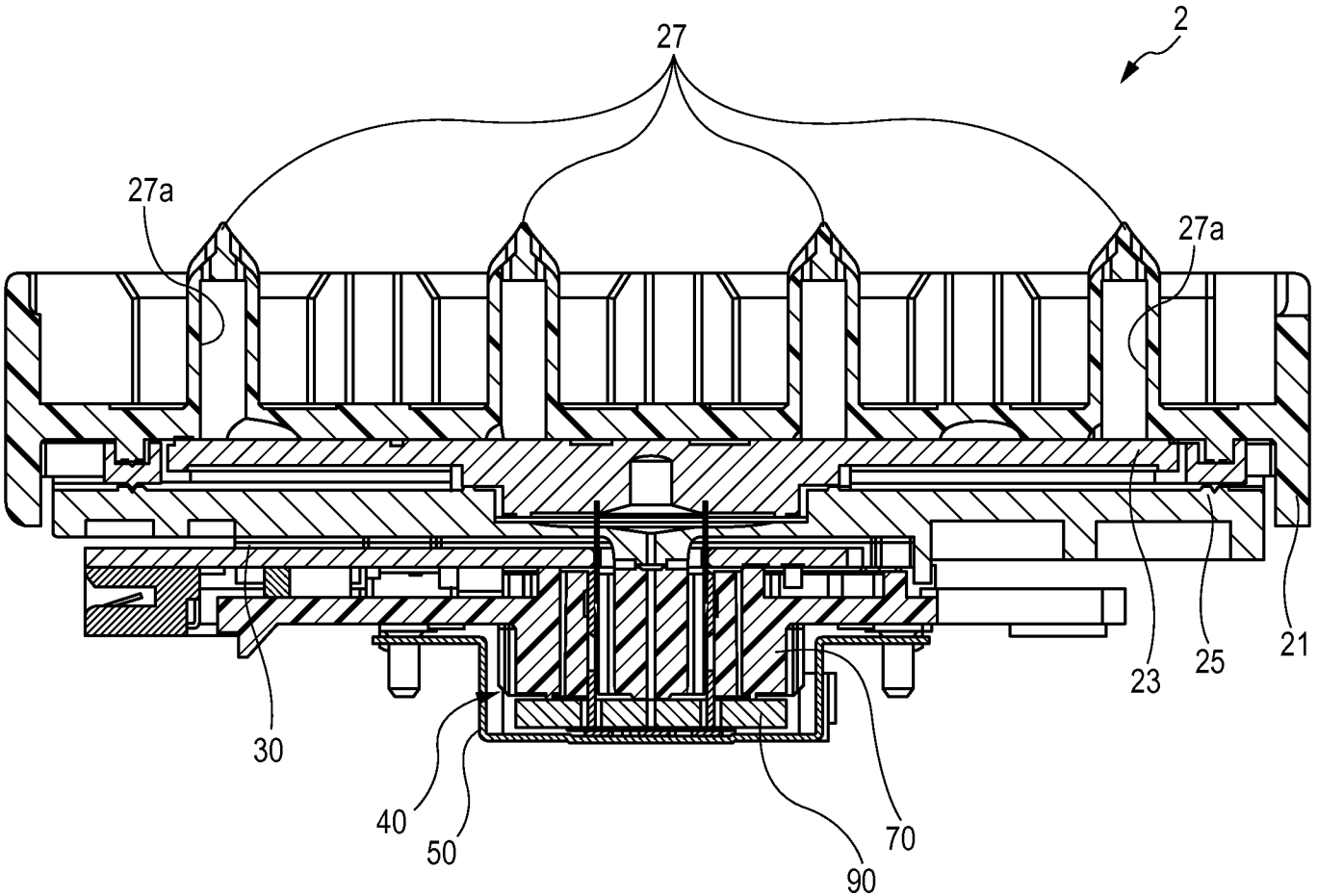
FIG. 3 is a sectional view illustrating the recording head unit.

Next, the recording head unit 2 will be described. FIG. 2 is an exploded perspective view illustrating the recording head unit 2. FIG. 3 is a sectional view illustrating the recording head unit 2. As shown in FIG. 2, the recording head unit 2 includes a holding member 20 on which ink cartridges 11 are mounted, a circuit substrate 30 that is installed on the surface opposite the ink cartridges 11 of the holding member 20, a recording head 40 that is mounted on the holding member 20 with the circuit substrate 30 interposed therebetween, and a head cover 50 that is mounted on the recording head 40.

The holding member 20 is a member that is fixed to the carriage 3, holding the recording head 40. The holding member 20 includes an ink introduction member 21, a circular seal member 22, a connection passage member 23, a plurality of filters 24, and a filter holding member 25.

Ink cartridge mounting portions 26 are formed in the ink introduction member 21 and the plurality of ink cartridges 11 are detachably mounted on the ink cartridge mounting portions 26. Further, four ink introduction needles 27 are formed in the ink cartridge mounting portions 26 so as to correspond to the four ink cartridges 11. When the ink cartridges 11 are mounted on the ink cartridge mounting portions 26, the ink introduction needles 27 are inserted into the ink cartridges 11. Then, the ink is introduced into the recording head unit 2 via each ink introduction passage 27*a* (see FIG. 3) formed inside each ink introduction needle 27.

The connection passage member 23 is a tabular member in which four intermediate passages 28 are formed through to correspond to the four ink introduction needles 27. The connection passage member 23 is disposed inside the circular seal member 22. The end of each intermediate passage 28 on the upstream side thereof communicates with each ink introduction passage 27*a* formed inside the ink introduction needle 27 of the ink introduction member 21. At the end of each intermediate passage 28 on the downstream side thereof, each filter 24 is mounted to be inserted between the connection passage member 23 and the filter holding member 25, and thus the ink flows through the filter 24.

The seal member 22 is mounted on the opposite side to the ink cartridge mounting portion 26 of the ink introduction member 21. The seal member 22 is formed of an elastic member, such as a resin, having a circular shape which surrounds the outer circumference of the connection passage member 23. Further, the seal member 22 is inserted between the ink introduction member 21 and the filter holding member 25 to seal an inner space surrounded by the ink introduction member 21, the seal member 22, and the filter holding member 25, that is, the periphery of the connection passage member 23.

The filter holding member 25 is a member which holds each filter 24 inserted between the filter holding member 25 and the connection passage member 23 and on which the recording head 40 is mounted. In the filter holding member 25, ink supply passages 29 are formed through in the plate thickness direction thereof. Therefore, the end of each ink supply passage 29 on the upstream side thereof communicates with the intermediate passage 28 of the connection passage member 23 via each filter 24. The filter holding member 25 are mounted on the ink introduction member 21 with the seal member 22, the connection passage member 23, and the filters 24 pinched therebetween to configure the holding member 20. Accordingly, in the holding member 20 configured in this way, the ink introduction passages 27*a* of the ink introduction member 21, the intermediate passages 28 of the connection passage member 23, and the ink supply passages 29 of the filter holding member 25 communicate with each other, and therefore a series of ink passages 100 is formed by these passages. The ink in the ink cartridges 11 is supplied to the recording head 40 via the ink passages 100.

The lower end of each ink supply passage 29 protrudes toward the recording head 40 from the lower surface of the filter holding member 25. Passage insertion holes 31 are formed in the circuit substrate 30. Therefore, the protruding portion of each ink supply passage 29 is inserted into each passage insertion hole 31 of the circuit substrate 30 and the lower end of the inserted ink supply passage 29 communicates with a passage (which is a case passage 72 to be described below) in the recording head 40 in a liquid-tight manner.

The circuit substrate 30 is disposed between the holding member 20 and the recording head 40. Electrical components such as an IC and a resistor are mounted on and a connector 32 is also mounted on the circuit substrate 30. Piezoelectric vibrators of the recording head 40 are electrically connected to the circuit substrate 30 via a flexible cable 82 and a signal cable connected to a control unit of the printer 1 is connected to the connector 32. The circuit substrate 30 controls an ink ejecting process to be performed by the recording head 40 by supplying a driving signal or the like transmitted from the control unit of the printer 1 via the signal cable to the vibrator unit 80 via the flexible cable 82.

Figure 4A:
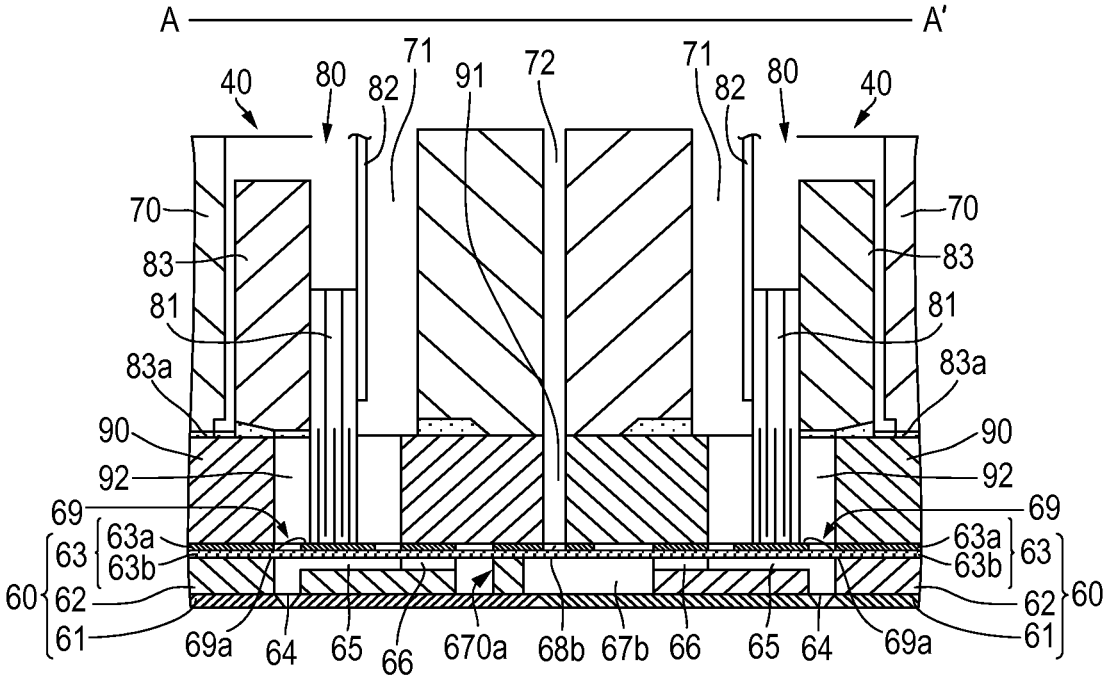
FIG. 4A is a cross sectional view illustrating a recording head along line A-A' in FIG. 6.
Figure 4B:
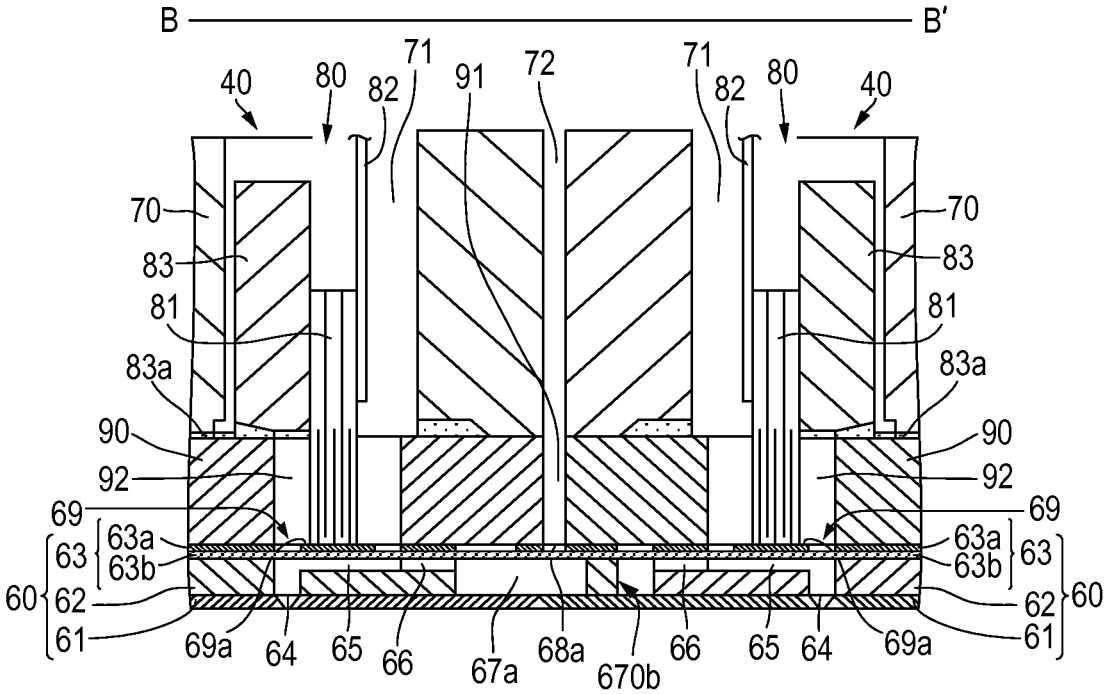
FIG. 4B is a cross sectional view illustrating a recording head along line B-B' in FIG. 6.
Figure 6:
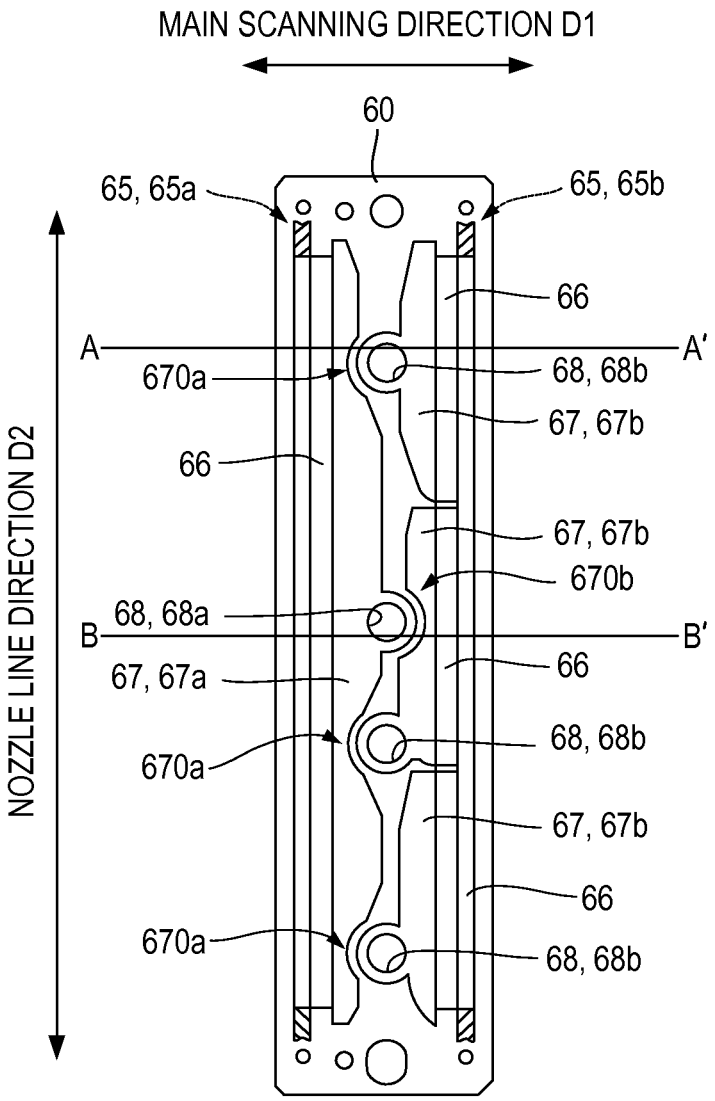
FIG. 6 is a plan view illustrating a passage unit.

Next, the configuration of the recording head 40 will be described. FIGS. 4A-4B are cross sectional views illustrating the recording head 40 along lines A-A' and B-B' in FIG. 6, respectively. As shown in FIGS. 4A-4B, the recording head 40 includes a passage unit (passage formation member) 60 in which passages such as a reservoir 67 and pressure generation chambers 65 are formed, the vibrator unit 80 which includes piezoelectric vibrators causing a change in the pressure of the ink inside the pressure generation chamber, a head case 70 that accommodates the vibrator unit 80 therein, and a reinforcing member 90 interposed between the head case 70 and the passage unit 60. In FIG. 4A, a second ink introduction port 68*b* (discussed later) is located at a center bottom area in FIG. 4A. The second ink introduction sort 68*b* is overlapped with a second ink reservoir 67*b* (discussed later) A recessed escape portion 670*a* (discussed later) is located at a right end of the second ink reservoir 67*b* as shown in FIG. 4A. The recessed escape portion 670*a* corresponds to an area located between a first ink reservoir 67*a* discussed later and the second ink reservoir 67*b* next to the second ink introduction port 68*b* as shown in FIGS. 4A and 6.

Similarly, in FIG. 4B, a first ink introduction port 68*a* (discussed later) is located at a center bottom area in FIG. 4B. The first ink introduction sort 68*a* is overlapped with the first ink reservoir 67*a*. A recessed escaped portion 670*b* discussed later is located at a left end of the first ink reservoir 67*a* as shown in FIG. 4B. The recessed escape portion 670*b* corresponds to an area located between the second ink reservoir 67*b* and the first ink reservoir 67*a*next to the first ink introduction port 68*a* as shown in FIGS. 4B and 6.

The passage unit 60 includes a nozzle plate 61, a passage formation substrate 62, and a vibration plate 63. The nozzle plate 61 is fixed to one surface of the passage formation substrate 62 by an adhesive and the vibration plate 63 is fixed to the other surface of the passage formation substrate 62 opposite the nozzle plate 61 by an adhesive.

Figure 5:
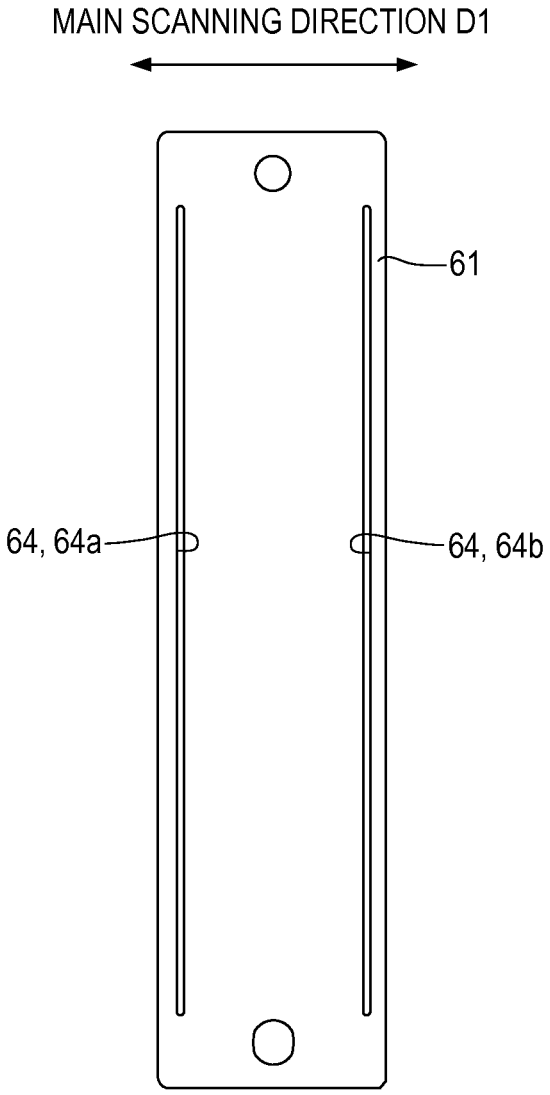
FIG. 5 is a plan view illustrating a nozzle plate.

The nozzle plate 61 is a thin metal plate such as a stainless steel plate. In the nozzle plate 61, nozzles 64 are formed at a predetermined pitch such as 180 dpi to correspond to the dot formation density of the recording head unit 2. The plurality of nozzles 64 are formed in a line shape in a direction perpendicular to the main scanning direction. Nozzle lines are formed by the nozzles 64 arranged in the line shape. In the nozzle plate 61 according to this embodiment, nozzle lines are formed at both ends of the nozzle plate 61, and thus two nozzle lines are formed, as shown in FIG. 5.

In the passage formation substrate 62, a plurality of void portions serving as the pressure generation chambers 65 are partitioned by partition walls are formed to correspond to the plurality of nozzles 64. Further, void portions serving as ink supply passages 66 and the reservoir 67 are formed. In the passage formation substrate 62, each series of passages communicating with the reservoir 67, the ink supply passage 66, and the pressure generation chamber 65 is formed by blocking the openings of the void portions so as to be pinched between the nozzle plate 61 and the vibration plate 63. In this embodiment, a substrate formed by etching a silicon wafer is used as the passage formation substrate 62.

The pressure generation chamber 65 is formed as a chamber elongated in a direction perpendicular to the nozzle line direction, and the ink supply passage 66 is formed as a narrowed portion that has a narrow passage width and communicates between the pressure generation chamber 65 and the reservoir 67. In the passage formation substrate 62, two lines of the pressure generation chambers 65 are formed to correspond to the two nozzle lines. The reservoir 67 is a common liquid chamber of the plurality of pressure generation chambers 65 and temporarily stores the ink supplied from the ink cartridge 11. Since the ink supply passage 66 corresponding to each pressure generation chamber 65 communicates with the reservoir 67, the ink is supplied from the reservoir 67 to the plurality of pressure generation chambers 65 via the ink supply passages 66.

The passage unit 60 will be further described. FIG. 6 is a plan view illustrating the passage unit 60. In the passage unit 60, as shown in FIG. 6, the reservoir 67 is formed for each of the two lines of the pressure generation chambers 65. One of the two lines of the pressure generation chambers 65 is referred to as a first pressure generation chamber 65*a* and the other line thereof is referred to as a second pressure generation chamber 65*b*. The nozzles communicating with the first pressure generation chamber 65*a* are referred to as first nozzles 64*a* and the nozzles communicating with the second pressure generation chamber 65*b* are referred to as second nozzles 64*b* (see FIG. 5).

In this embodiment, of the two reservoirs 67, the reservoir corresponding to the second pressure generation chamber 65*b* is partitioned into three second reservoirs 67*b* by partition walls. Thus, in the passage unit 60, a total of four reservoirs 67 are formed to correspond to the ink cartridges 11 of four colors. The first reservoir 67*a* which is not partitioned corresponds to a first liquid storage chamber and the partitioned three second reservoirs 67*b* correspond to a second liquid storage chamber.

Parts of the reservoirs 67 extend from the nozzle lines toward the middle of the nozzle plate 61. Thus, in the extension portions, the reservoirs 67 communicate with ink introduction ports 68 opened through the vibration plate 63. Therefore, each reservoir 67 communicates with each ink cartridge 11 from the ink introduction port 68 of the vibration plate 63 via the case passage 72 formed in the head case 70, a through-passage 91 formed in the reinforcing member 90, and the ink passage 100 of the holding member 20. Each reservoir 67 communicates with each pressure generation chamber 65 via the ink supply passage 66 formed to correspond to each pressure generation chamber 65. Thus, each reservoir 67 stores the ink supplied from each ink cartridge 11 and supplies the stored ink to the plurality of pressure generation chambers 65.

As shown in FIG. 6, the first reservoir 67*a* and the second reservoirs 67*b* are formed in parallel so as to be spaced in the main scanning direction. Thus, the four ink introduction ports 68 (a first ink introduction port 68*a* and second ink introduction ports 68*b*) are formed at different positions in a nozzle line direction D2 perpendicular to a main scanning direction D1. Further, the four ink introduction ports 68 are lined up straight in the nozzle line direction D2. The first ink introduction port 68*a* and the second ink introduction ports 68*b* are formed at the same position in the main scanning direction D1. The main scanning direction corresponds to a first direction and the nozzle line direction corresponds to a second direction.

In the first reservoir 67*a*, recessed escape portions 670*a* are formed opposite the second ink introduction ports 68*b* in portions oriented toward the second ink introduction ports 68*b* of the second reservoirs 67*b*. Likewise, in each second reservoir 67*b*, a recessed escape portion 670*b* is formed opposite to the first ink introduction port 68*a* in a portion oriented toward the first ink introduction port 68*a* of the first reservoir 67*a*. A part of the first ink introduction port 68*a* protrudes toward the escape portion 670*b*, and thus the first ink introduction port 68*a* is formed at a position closer to the second reservoir 67*b* to the extent that the part of the ink introduction port 68*a* protrudes toward the escape portion 670*b*. Likewise, a part of the second ink introduction port 68*b* protrudes toward the escape portion 670*a*, and thus the second ink introduction port 68*b* is formed at a position closer to the first reservoir 67*a* to the extent that the part of the ink introduction port 68*b* protrudes toward the escape portion 670*a*. The shapes of the first reservoir 67*a* and the second reservoir 67*b* are set so that the ink supply pressures to the ink supply passages 66 communicating with the pressure generation chambers 65 forming the lines of the pressure generation chambers 65 are substantially uniform in addition of the influence of the recessed escape portions 670. Of course, the positions at which the ink introduction ports 68 are formed with respect to the reservoir 67 are not limited to the configuration in which the ink introduction ports 68 are disposed at the positions deviated from the vicinity of the middle of the reservoir 67, as shown in FIG. 6. The ink supply pressures to the ink supply passages 66 may be made to be substantially uniform by disposing the ink introduction ports 68 in the vicinity of the middle of the reservoir 67.

The vibration plate 63 is a plate that has a double structure in which a resin film 63*b* such as a PPS (polyphenylene sulfide) film is formed on a supporting plate 63*a* formed of a metal material such as stainless steel through a lamination process. In the vibration plate 63, the plurality of ink introduction ports 68 vertically opened are formed to correspond to four reservoirs 67. Therefore, the case passage 72 communicates with the reservoir 67 via the ink introduction port 68.

In the vibration plate 63, as shown in FIGS. 4A-4B, a diaphragm portion 69 that change the volume of the pressure generation chamber 65 is formed in a portion corresponding to the pressure generation chamber 65 by sealing one opening surface of the pressure generation chamber 65. The diaphragm portion 69 is manufactured by etching the supporting plate 63*a* of a portion corresponding to the pressure generation chamber 65 between the plates of the above-described double structure to remove the supporting plate 63*a* of the portion corresponding to the pressure generation chamber 65 in a circular shape and forming an island portion 69*a* which joins the front end of a free end portion of the piezoelectric vibrator of the vibrator unit 80. The island portion 69*a* is smaller than the region corresponding to the pressure generation chamber 65. The resin film 63*b* around the island portion 69*a* in which the supporting plate 63*a* is removed by the etching process, that is, the resin film 63*b* in the region where the island portion 69*a* is not formed in the region corresponding to the pressure generation chamber 65 functions as an elastic film.

In each portion of the vibration plate 63 corresponding to each reservoir 67, the supporting plate 63 *a* is removed through an etching process in the shape of the opening of the void serving as the reservoir 67 formed in the passage forming substrate 62 and the remaining resin film 63*b* serves as a compliance portion 63*c*. The compliance portion 63*c* seals one opening surface of the void serving as the reservoir 67 so that compliance can be given to the ink in the reservoir 67.

The head case 70 is a box-like member in which accommodation void portions 71 are formed to accommodate the vibrator unit 80. The holding member 20 having an ink passage in which the ink introduced into the recording head unit 2 flows is mounted on one surface of the head case 70. The passage unit 60 is attached and fixed to the surface of the head case 70 opposite the holding member 20. Inside the head case 70, two lines of the accommodation void portions 71 accommodating the vibrator unit 80 and each case passage 72 through which the ink supplied from the ink passage of the holding member 20 is supplied to the reservoir 67 are through formed in a direction oriented from the holding member 20 toward the passage unit 60.

In the head case 70, four case passages 72 formed through the head case 70 in the height direction thereof are arranged to correspond to the four reservoirs 67. The end of each case passage 72 on the upstream side communicates with each ink passage 100 of the holding member 20 and the end of the case passage 72 on the downstream side communicates with each through-passage 91 of the reinforcing member 90.

Figure 7:
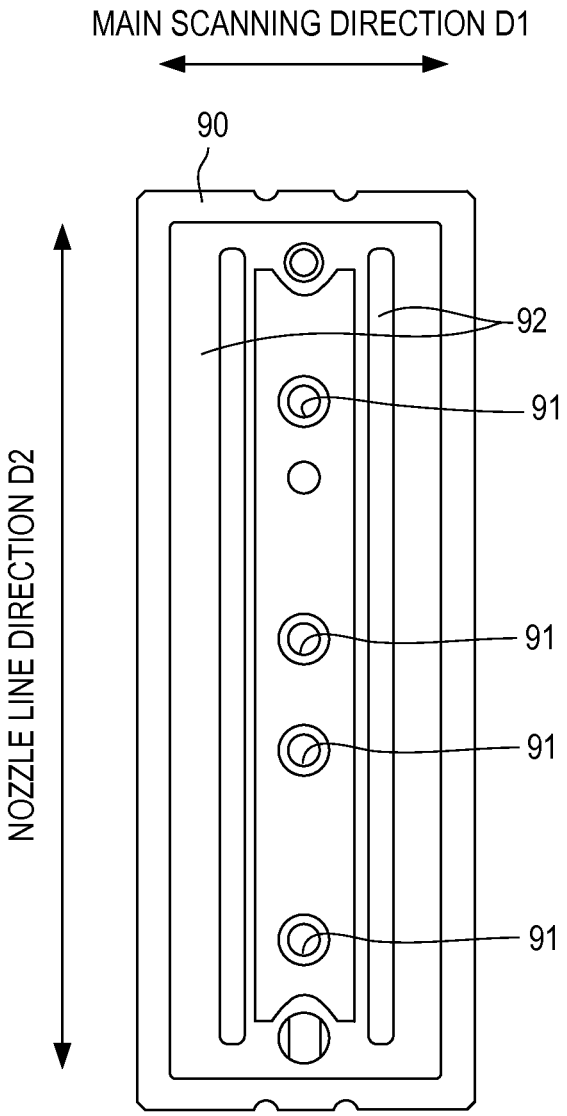
FIG. 7 is a plan view illustrating a reinforcing member.

Next, the reinforcing member 90 will be described. FIG. 7 is a plan view illustrating the reinforcing member 90. The reinforcing member 90 is a plate-shaped member that has rigidity higher than the head case 70 joined to the vibration plate 63 of the passage unit 60. For example, since the linear expansion coefficient of the head case 70 made of resin is larger than the linear expansion coefficient of the substrate of the passage unit 60, an amount of deformation of the head case 70 is larger when temperature or humidity changes. The reinforcing member 90 is interposed between the head case 70 and the passage unit 60 so that the deformation of the head case 70 does not affect the passage unit 60 and the vibrator unit 80. Therefore, in the recording head 40 according to this embodiment, the head case 70 is formed of a stainless steel plate thicker than the passage unit 60 so as to have rigidity higher than the passage unit 60. Two lines of insertion ports 92 formed through the plate thickness direction are opened to correspond to the two lines of the pressure generation chambers 65. The front ends of the piezoelectric vibrators 81 of the vibrator unit 80 are inserted into the insertion ports 92 and a fixing plate 83 of the vibrator unit 80 is joined to the edges of the openings of the insertion ports 92 on the side of the head case 70 (see FIGS. 4A-4B). The head case 70 is joined to the surface of the reinforcing member 90 opposite the passage unit 60 so that the accommodation void portions 71 of the head case 70 communicate with the insertion ports 92 of the reinforcing member 90. Moreover, four through-passages 91 of which one end communicates with the case passage 72 of the head case 70 and the other end communicates with the ink introduction port 68 of the vibration plate 63 are arranged between the two lines of the insertion ports 92 of the reinforcing member 90. The through-passage 91 on the upstream side communicates with the case passage 72 on the downstream side in a liquid-tight manner. The through-passage 91 on the downstream side communicates with the ink introduction port 68 of the passage unit 60 in a liquid-tight manner.

As described above, the recording head 40 according to this embodiment has a configuration in which each ink passage 100 of the holding member 20, each case passage 72 of the head case 70, each through-passage 91 of the reinforcing member 90, and each ink introduction port 68 of the passage unit 60 form a series of passages communicating with each other. Thus, the ink of each ink cartridge 11 is supplied to the reservoir 67 of the passage unit 60 via the ink passage 100, the case passage 72, the through-passage 91, and the ink introduction port 68. In this embodiment, the ink is supplied from the ink cartridge 11 for black ink to the first reservoir 67*a*. The ink is supplied to the three second reservoirs 67*b* from the ink cartridges 11 for cyan ink, magenta ink, and yellow ink.

Next, the vibrator unit 80 will be described. As shown in FIGS. 4A-4B, the vibrator unit 80 includes the piezoelectric vibrator 81, the flexible cable 82, and the fixing plate 83. The piezoelectric vibrator 81 has a long and thin pectinate shape and is separated by a very narrow width of about a few tens of μm. The piezoelectric vibrator 81 is configured as a vertical vibration type piezoelectric vibrator that can be expanded and contracted in a longitudinal direction. One end of the piezoelectric vibrator 81 is joined on the fixing plate 83 to be configured as a fixing end and the other end thereof configured as a free end protrudes outward from the front end edge of the fixing plate 83 so that the piezoelectric vibrator 81 is fixed in a so-called cantilevering state. The front end of the free end of the piezoelectric vibrator 81 is fixed to the island portion 69a of the diaphragm portion 69 in the passage unit 60.

The fixing plate 83 supporting each piezoelectric vibrator 81 is formed of a metal plate material having rigidity to receive a reactive force from each piezoelectric vibrator 81. For example, the fixing plate 83 is manufactured from a stainless steel plate with a thickness of about 1 mm. Further, one end of the flexible cable 82 is electrically connected to each piezoelectric vibrator 81 on the side surface of the piezoelectric vibrator 81 opposite the fixing plate 83, and thus is connected to the circuit substrate 30. Thus, the expansion and the contraction of the piezoelectric vibrator 81 are controlled by transmitting a signal from the controller of the printer 1 to each piezoelectric vibrator 81 via the circuit substrate 30 and the flexible cable 82.

A part of the end surface of the fixing plate 83 on the side of the reinforcing member is adhered and fixed to the edge of each insertion port 92 of the reinforcing member 90. A chamfered portion 83*a* formed by chamfering the corner of the fixing plate 83 opposite each piezoelectric vibrator 81 is formed on the end surface of the fixing plate 83 facing the reinforcing member 90. The fixing plate 83 is fixed to the reinforcing member 90 by applying a UV cured resin, which is a kind of adhesive, to the chamfered portion 83*a*, connecting the chambered portion 83*a* to the reinforcing member 90, and then curing the UV cured resin through UV radiation.

In the recording head 40 having the above-described configuration, the front end surface of each piezoelectric vibrator 81 is joined to the island portion 69*a* of the diaphragm portion 69. Therefore, when each piezoelectric vibrator 81 is expanded and contracted by causing a driving unit such as a driving circuit (not shown) to drive each piezoelectric vibrator 81, the volume of each pressure generation chamber 65 is changed through the diaphragm portion 69 and thus the pressure of the ink in each pressure generation chamber 65 is changed. Then, when the recording head 40 ejects the ink in each pressure generation chamber 65 from each nozzle 64 using the change in the pressure of the ink, ink droplets are ejected toward a landing target such as a recording sheet.

In the recording head 40 according to this embodiment, as described above, the first reservoir 67*a* and the second reservoirs 67*b* are formed in parallel so as to be spaced in the main scanning direction D1. Thus, the four ink introduction ports 68 (the first ink introduction port 68*a* and the second ink introduction ports 68*b*) are formed at different positions in the nozzle line direction D2 perpendicular to a main scanning direction D1. Accordingly, the first ink introduction port 68*a* of the first reservoir 67*a* and the second ink introduction ports 68*b* of the second reservoirs 67*b* are arranged in one line in the nozzle line direction D2 without interference of the four ink introduction ports 68.

Figure 8:
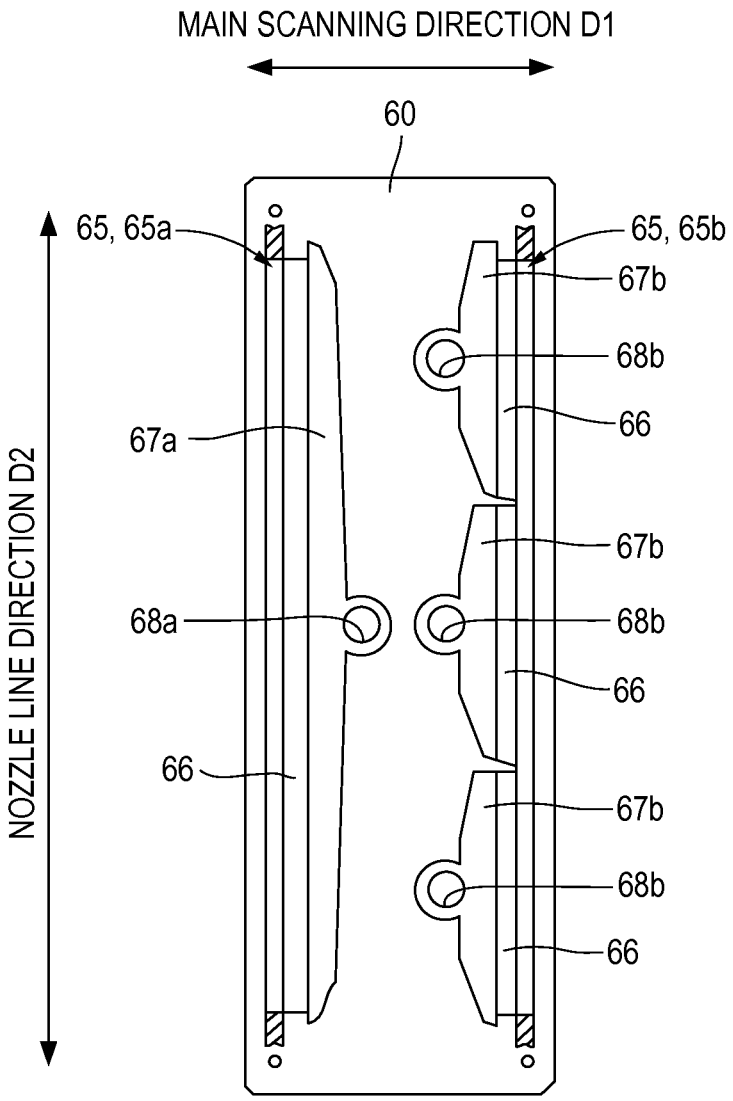
FIG. 8 is a diagram illustrating a configuration according to a comparative example.

FIG. 8 is a diagram illustrating an example of a passage unit 60 in which a first ink introduction port 68*a* of a first reservoir 67*a* and a second ink introduction port 68*b* of second reservoirs 67*b* are arranged at the same position in a nozzle line direction D2 according to a comparative example of the embodiment. In this case, since the second ink introduction port 68*b* of the second reservoir 67*b* is formed at a position facing the first ink introduction port 68*a* of the first reservoir 67*a*, it is necessary to ensure a space in which the two ink introduction ports 68 are arranged in series between the first reservoir 67*a* and the second reservoir 67*b*. The space between the first reservoir 67*a* and the second reservoir 67*b* spreads, and thus the size of the recording head 40 may increase. Not only the passage unit 60 but also the other configuration of the recording head 40 such as the configuration of the reinforcing member 90 has to be set to have larger dimensions to correspond to the space between the first reservoir 67*a* and the second reservoir 67*b*.

In the recording head 40 according to this embodiment, however, the first ink introduction port 68*a* and the second ink introduction port 68*b* are arranged at different positions in the nozzle line direction D2. Therefore, the first ink introduction port 68*a* and the second ink introduction port 68*b* do not interfere with each other. Accordingly, it is not necessary to ensure the space in which the two ink introduction ports 68 are arranged in series by increasing the space between the first reservoir 67*a* and the second reservoir 67*b*. Moreover, the four ink introduction ports 68 can be arranged in one line at a narrow interval. Thus, the recording head 40 can be miniaturized. Moreover, the printer 1 can be miniaturized and improved in terms of a lightweight property with the reduction in the size of the recording head 40.

As shown in FIG. 6, each first pressure generation chamber and each first nozzle are formed on the opposite side of the second reservoir 67*b* with respect to the first reservoir 67*a* and each second pressure generation chamber and each second nozzle are formed on the opposite side of the first reservoir 67*b* with respect to the second reservoir 67*b*. Since the pressure generation chambers and the nozzles are not formed between the first reservoir 67*a* and the second reservoir 67*b*, it is not necessary to enlarge the space between first reservoir 67*a* and the second reservoir 67*b* in order to arrange the pressure generation chambers and the nozzles. Thus, the miniaturized liquid ejecting head can be obtained.

In the first reservoir 67*a*, the escape portions 670*a* are formed at the portions oriented toward the second ink introduction ports 68*b* of the second reservoir 67*b*. In the second reservoir 67*b*, the escape portion 670*b* is formed in the portion oriented toward the first ink introduction port 68*a* of the first reservoir 67*a*. Therefore, since the first reservoir 67*a* and the second reservoir 67*b* can be formed to be closer to each other in the main scanning direction D1, the recording head 40 can be further miniaturized.

The embodiment of the invention has hitherto been described, but the invention is not limited thereto. The invention can be modified and improved in various forms without departing from the gist and claims of the invention. The invention of course includes the equivalents of the modifications and improvements. Hereinafter, modification examples will be described.

MODIFICATION EXAMPLE 1

Figure 9:
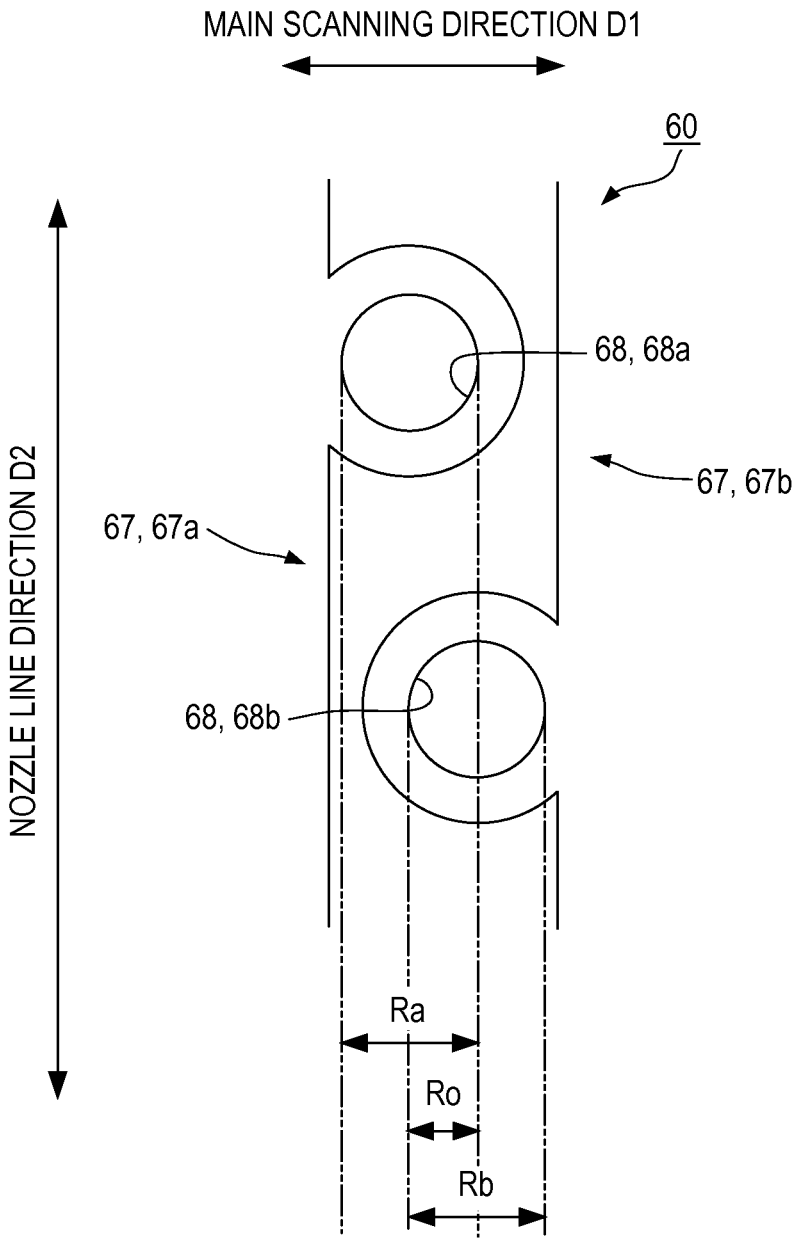
FIG. 9 is a diagram according to a first modification example.

In the above-described embodiment, the case has been described in which the four ink introduction ports 68 are formed in parallel in a straight line in the nozzle line direction D2, and the first ink introduction port 68*a* and the second ink introduction ports 68*b* are arranged at the same position in the main scanning direction D1. However, the four ink introduction ports 68 may not be formed in parallel in a straight line. For example, as shown in FIG. 9, a range Ra of the first ink introduction port 68*a* and a range Rb of the second ink introduction port 68*b* may overlap each other by an overlapping range (Ro) in the main scanning direction D1, and the first ink introduction port 68*a* and the second ink introduction port 68*b* may be arranged at different positions in the nozzle line direction D2. In this case, according to the comparative example in FIG. 8, since the first ink introduction port 68*a* and the second ink introduction port 68*b* overlap each other by the overlapping range (Ro), the gap between the first reservoir 67*a* and the second reservoir 67*b* can be narrowed, and therefore the recording head 40 can be miniaturized. As in the above-described embodiment, the recording head can be further miniaturized when the first ink introduction port 68*a* and the second ink introduction port 68*b* are arranged at the same position in the nozzle line direction D.

Figure 10:
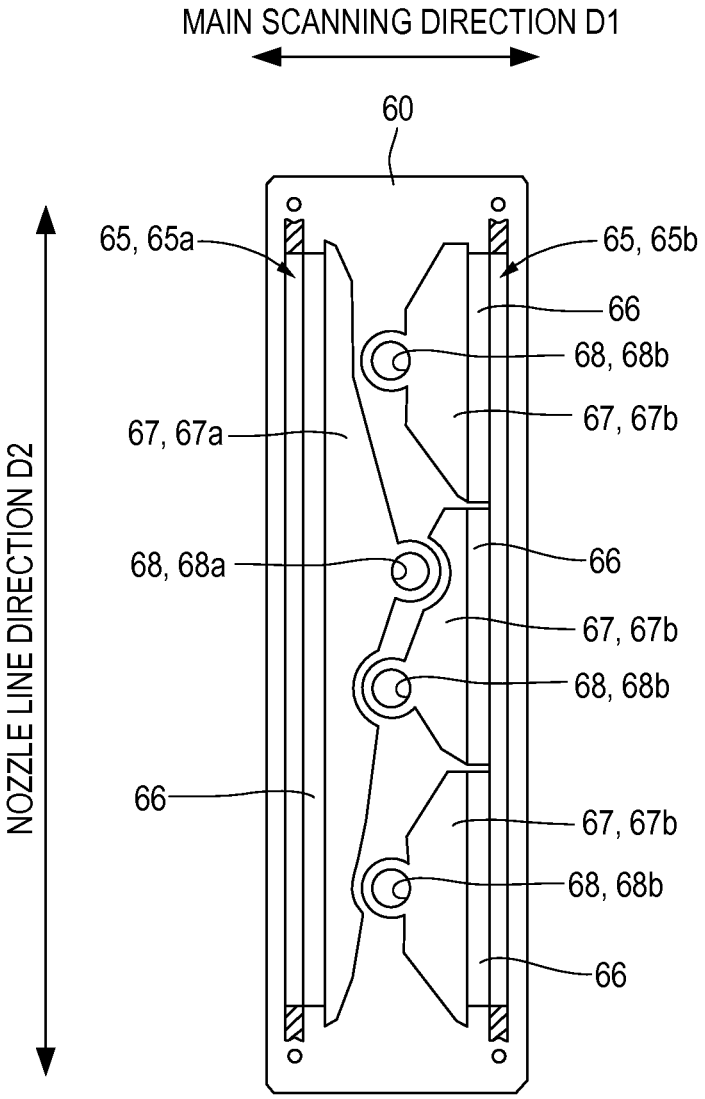
FIG. 10 is a diagram according to the first modification example.

As shown in FIG. 10, the first ink introduction port 68*a* may be disposed on the side of the second reservoir 67*b* from the second ink introduction port 68*b*, and the second ink introduction ports 68*b* may be disposed on the side of the first reservoir 67*a* from the first ink introduction port 68*a*. Even in this case, since the first ink introduction port 68*a* and the second ink introduction ports 68*b* overlap each other partially in the main scanning direction D1, the gap between the first reservoir 67*a* and the second reservoir 67*b* can be narrowed, and therefore the recording head 40 can be miniaturized. Further, since a long gap can be reliably ensured between each ink introduction port 68 and the ink supply passage 66, a variation in the ink supply pressure to the ink supply passage 66 connected to each pressure generation chamber 65 decreases. Therefore, a more suitable ejection characteristic can be obtained.

MODIFICATION EXAMPLE 2

In the above-described embodiment, the case has been described in which the three second reservoirs 67*b* are partitioned and cyan ink, magenta ink, and yellow ink are allocated to the three partitioned second reservoirs 67*b*, respectively. However, the number of partitioned reservoirs and the kinds of allocated ink are not limited thereto. Further, the invention is applicable to a recording head in which the second reservoir 67*b* is not partitioned.

MODIFICATION EXAMPLE 3

In the above-described embodiment, the recording head ejecting the ink using the so-called vertical vibration type piezoelectric element has been described as an example of the liquid ejecting head, but the invention is not limited to the liquid ejecting head. For example, a liquid ejecting head using a flexible mode piezoelectric element or a liquid ejecting head using a shared mode piezoelectric element may be used. Further, a liquid ejecting head that causes a change in the pressure of the liquid in a pressure generation chamber due to heating of a heating element or a liquid ejecting head that causes a change in the pressure of the liquid in a pressure generation chamber by an electrostatic actuator may be used. Furthermore, a line type liquid ejecting head may be used.

MODIFICATION EXAMPLE 4

In the above-described embodiment, the recording head ejecting ink as an example of a liquid and the printer as an example of a liquid ejecting apparatus have been described. However, a liquid ejecting head ejecting a liquid other than ink or a liquid ejecting apparatus including this liquid ejecting head may be used. Examples of a liquid to be ejected include a solution of each color used in a color filter of a liquid crystal display, a solution of an organic EL material used in an organic EL (Electro Luminescence) display, and a liquid-phase electrode material used to form an electrode of an FED (Field Emission Display) or the like. Examples of the liquid ejecting head ejecting such liquids include a color material ejecting head used to manufacture a color filter of a liquid crystal display or the like or an organic EL (Electro Luminescence) display apparatus, an electrode material ejecting head used to form an electrode of an FED or the like, and a bio-organism ejecting head used to manufacture a bio chip.

The entire disclosure of Japanese Patent Application No. 2011-169837, filed Aug. 3, 2011 is incorporated by reference herein.

What is claimed is:

1. A liquid ejecting head, comprising:

a passage formation member having a member surface;

first and second liquid storage chambers storing a liquid, the first and second liquid storage chambers being formed in the passage formation member, the first and second liquid storage chambers being spaced apart from each other in a first direction with respect to the member surface, the first and second liquid storage chambers each having an elongated part in a second direction perpendicular to the first direction;

a first introduction port through which the liquid stored in the first liquid storage chamber is introduced; and a second introduction port through which the liquid stored in the second liquid storage chamber is introduced, wherein the first introduction port and the second introduction port are formed between the elongated part of the first liquid storage chamber and the elongated part of the second liquid storage chamber, the first and second introduction ports are aligned in the second direction so that at least parts of the first and second introduction ports overlap each other in the second direction, in the passage formation member:

a first pressure generation chamber that is formed on an opposite side to the second liquid storage chamber with respect to the first liquid storage chamber and communicates with the first liquid storage chamber, and a first nozzle that ejects the liquid of the first pressure generation chamber are formed, and a second pressure generation chamber that is formed on an opposite side to the first liquid storage chamber with respect to the second liquid storage chamber and communicates with the second liquid storage chamber, and a second nozzle that ejects the liquid of the second pressure generation chamber are formed, and in the passage formation member, a plurality of the second liquid storage chambers are formed, and the second introduction port of each of the second liquid storage chambers and the first introduction port of the first liquid storage chamber are formed at different positions in the second direction.

2. The liquid ejecting head according to claim 1, wherein the first and second introduction ports are lined up in the second direction.

3. The liquid ejecting head according to claim 1, wherein at least a part of the first liquid storage chamber that is oriented toward the second introduction port of the second liquid storage chamber is recessed toward an opposite side to the second liquid storage chamber.

4. A liquid ejecting apparatus comprising:

a liquid ejecting head, the liquid ejecting head includes:

a passage formation member having a member surface;

first and second liquid storage chambers storing a liquid, the first and second liquid storage chambers being formed in the passage formation member, the first and second liquid storage chambers being spaced apart from each other in a first direction with respect to the member surface, the first and second liquid storage chambers each having an elongated part in a second direction perpendicular to the first direction;

a first introduction port through which the liquid stored in the first liquid storage chamber is introduced; and a second introduction port through which the liquid stored in the second liquid storage chamber is introduced, wherein the first introduction port and the second introduction port are formed between the elongated part of the first liquid storage chamber and the elongated part of the second liquid storage chamber, the first and second introduction ports are aligned in the second direction so that at least parts of the first and second introduction ports overlap each other in the second direction, a first pressured generation chamber and a first nozzle are formed in the passage formation member, the first pressure generation chamber being formed on an opposite side to the second liquid storage chamber with respect to the first liquid storage chamber and communicating with the first liquid storage chamber, and the first nozzle ejecting the liquid of the first pressure generation chamber, a second pressure generation and a second nozzle are formed in the passage formation member, the second pressure generation chamber being formed on an opposite side to the first liquid storage chamber with respect to the second liquid storage chamber and communication with the second liquid storage chamber and the second nozzle ejecting the liquid of the second pressure generation chamber, a plurality of the second liquid storage chambers are formed in the passage formation member, and the second introduction port of each of the second liquid storage chambers and the first introduction port of the first liquid storage chamber are formed at different positions in the second direction.

5. The liquid ejecting apparatus according to claim 4, wherein the first and second introduction ports are lined up in the second direction.

6. The liquid ejecting apparatus according to claim 4, wherein at least a part of the first liquid storage chamber that is oriented toward the second introduction port of the second liquid storage chamber is recessed toward an opposite side to the second liquid storage chamber.

7. The liquid ejecting head according to claim 1, wherein the first direction is a scanning direction of the liquid ejecting head, and the second direction is a nozzle alignment direction of nozzles through which the liquid is ejected.

8. The liquid ejecting apparatus according to claim 4, wherein the first direction is a scanning direction of the liquid ejecting head, and the second direction is a nozzle alignment direction of nozzles through which the liquid is ejected.

9. The liquid ejecting head according to claim 1, wherein the first and second introduction ports only partially overlap each other.

10. The liquid ejecting head according to claim 1, wherein the first and second introduction ports introduce different types of the liquid.

11. The liquid ejecting apparatus according to claim 4, wherein the first and second introduction ports only partially overlap each other.

12. The liquid ejecting apparatus according to claim 4, wherein the first and second introduction ports introduce different types of the liquid.

13. A liquid ejecting head, comprising:

a passage formation member having a member surface;

first and second liquid storage chambers storing a liquid, the first and second liquid storage chambers being formed in the passage formation member, the first and second liquid storage chambers being spaced apart from each other in a first direction with respect to the member surface, the first and second liquid storage chambers each having an elongated part in a second direction perpendicular to the first direction;

a first introduction port through which the liquid stored in the first liquid storage chamber is introduced; and a second introduction port through which the liquid stored in the second liquid storage chamber is introduced, wherein the first introduction port and the second introduction port are formed between the elongated part of the first liquid storage chamber and the elongated part of the second liquid storage chamber, the first and second introduction ports are aligned in the second direction so that at least parts of the first and second introduction ports overlap each other in the second direction, in the passage formation member:

a first pressure generation chamber that is formed on an opposite side to the second liquid storage chamber with respect to the first liquid storage chamber and communicates with the first liquid storage chamber, and a first nozzle that ejects the liquid of the first pressure generation chamber are formed, and a second pressure generation chamber that is formed on an opposite side to the first liquid storage chamber with respect to the second liquid storage chamber and communicates with the second liquid storage chamber, and a second nozzle that ejects the liquid of the second pressure generation chamber are formed, and at least a part of the first liquid storage chamber that is oriented toward the second introduction port of the second liquid storage chamber is recessed toward an opposite side to the second liquid storage chamber.

14. The liquid ejecting head according to claim 13, wherein the first and second introduction ports are lined up in the second direction.

15. The liquid ejecting head according to claim 13, wherein the first direction is a scanning direction of the liquid ejecting head, and the second direction is a nozzle alignment direction of nozzles through which the liquid is ejected.

16. The liquid ejecting head according to claim 13, wherein the first and second introduction ports only partially overlap each other.

* * * * *